US009695034B2

(12) United States Patent
Sauer

(10) Patent No.: US 9,695,034 B2
(45) Date of Patent: Jul. 4, 2017

(54) APPARATUS FOR CONVEYING VISCOUS MATERIAL

(71) Applicant: SCA Schucker GmbH & Co. KG, Bretten (DE)

(72) Inventor: Bernhard Sauer, Oelbronn-Duerrn (DE)

(73) Assignee: SCA Schucker GmbH & Co. KG, Bretten (DE)

( * ) Notice: Subject to any disclaimer, the term of this patent is extended or adjusted under 35 U.S.C. 154(b) by 20 days.

(21) Appl. No.: 14/801,226

(22) Filed: Jul. 16, 2015

(65) Prior Publication Data

US 2016/0016786 A1 Jan. 21, 2016

(30) Foreign Application Priority Data

Jul. 17, 2014 (DE) ..... 10 2014 010 500
Aug. 6, 2014 (DE) ..... 10 2014 011 395

(51) Int. Cl.

| | |
|---|---|
| ***B67D 7/64*** | (2010.01) |
| ***B67D 7/02*** | (2010.01) |
| ***B05C 11/10*** | (2006.01) |
| ***B05B 9/04*** | (2006.01) |
| ***B05B 9/047*** | (2006.01) |
| *B05C 11/11* | (2006.01) |

(52) U.S. Cl.

CPC ..... *B67D 7/645* (2013.01); *B05C 11/10* (2013.01); *B05C 11/1028* (2013.01); *B67D 7/0227* (2013.01); *B05B 9/047* (2013.01); *B05B 9/0409* (2013.01); *B05C 11/11* (2013.01); *Y10T 137/86035* (2015.04)

(58) Field of Classification Search

CPC ..... B67D 7/645; B67D 7/0227; B05B 9/047; Y10T 137/86035; B05C 11/1028

See application file for complete search history.

(56) References Cited

U.S. PATENT DOCUMENTS 2,280,708 A * 4/1942 Klein ..... F04B 7/0073 222/259
2,627,814 A * 2/1953 Davis ..... F16N 5/00 222/260

(Continued)

FOREIGN PATENT DOCUMENTS

DE 10 2004 030 654 A1 1/2006

*Primary Examiner* — Atif Chaudry
(74) *Attorney, Agent, or Firm* — Collard & Roe, P.C.

(57) ABSTRACT

An apparatus for conveying viscous material out of a barrel-like container having a container bottom and a container wall that extends upward from the container bottom has a follower plate for closing off the container, which plate is movable in the direction toward the container bottom, lying against the inner surface of the container wall, which surface faces the container interior, and which plate has a dome that extends upward from an underside intended to lie on the viscous material, which dome opens, in the center, into a material exit opening. The apparatus has a pump for conveying the viscous material through the material exit opening. At least one displacement body projects into the dome through the material exit opening and is connected with the pump for displacement of the material situated in the dome and/or air situated in the dome, and at least one closeable venting opening vents the dome.

13 Claims, 4 Drawing Sheets

(56) References Cited

U.S. PATENT DOCUMENTS

| | | | | | |
|---|---|---|---|---|---|
| 2,630,248 | A * | 3/1953 | Hinz | B67D 7/0227 | 222/258 |
| 3,160,105 | A * | 12/1964 | Sherman | F04B 5/00 | 417/262 |
| 3,282,469 | A * | 11/1966 | Skonberg | B29B 13/022 | 219/421 |
| 3,478,930 | A * | 11/1969 | Rigby | B65B 63/08 | 165/66 |
| 4,195,755 | A * | 4/1980 | Slautterback | B29B 13/022 | 219/230 |
| 4,592,491 | A * | 6/1986 | Chollet | B05C 11/10 | 141/65 |
| 5,887,752 | A * | 3/1999 | Strother | B67D 7/0244 | 222/1 |
| 6,457,356 | B1 * | 10/2002 | Meloche | B67D 7/0227 | 222/262 |
| 2008/0023082 | A1 | 1/2008 | Schucker | | |

* cited by examiner

APPARATUS FOR CONVEYING VISCOUS MATERIAL

CROSS REFERENCE TO RELATED APPLICATIONS

Applicant claims priority under 35 U.S.C. §119 of German Application Nos. 10 2014 011 395.7 filed Aug. 6, 2014 and 10 2014 010 500.8 filed Jul. 17, 2014, the disclosures of which are incorporated by reference.

BACKGROUND OF THE INVENTION

1. Field of the Invention

The invention relates to an apparatus for conveying viscous material.

2. Description of the Related Art

Such an apparatus is known, for example, from DE 10 2004 030 654 A1. It serves for conveying viscous material, such as, for example, adhesives, sealants or insulation materials, out of a barrel-like container, for example toward an application apparatus. In this connection, the container is closed off, toward the top, by a follower plate that follows the course of the material level in the container, which decreases during the course of the conveying process and, in this connection, lies against the inner surface of the container wall, forming a seal. The follower plate has a dome in the center, which extends upward from an underside of the follower plate. The follower plate applies slight pressure to the material, lying against it, and opens into a material exit opening. A pump conveys the viscous material through the material exit opening with operating pressure.

Once emptied, a container is replaced with a full container. In this connection, either the follower plate remains at the bottom in the emptied container, and the pump is uncoupled from it, so that the container along with the follower plate can be transported to a filling station, in which new material is filled in through the material exit opening, until the follower plate forms the upper end of the container once again, or the follower plate connected with the pump is pulled out of the container, and the container is transported away to be filled again. A filled container is placed under the pump and, in the case of the first alternative described above, the pump is set onto the dome, while in the case of the second alternative described above, the follower plate connected with the pump is set onto the material contained in the container. In both cases, however, the problem exists that air can collect in the dome and/or in an end region of the pump, with which air the material conveyed after refilling is mixed. In order to achieve reliable material application, the air or material contaminated with air must therefore first be pumped away; this material cannot be used and must therefore be disposed of. This venting takes place manually, in that a worker pumps material out of the container until this material no longer contains any air. This method is imprecise. In order to ensure that the material that has been pumped away is usable, the tendency therefore is to pump away too much material, in case of doubt. Pumping away too much material is particularly disadvantageous if this material is expensive, and this material generally has to be disposed of as hazardous waste.

SUMMARY OF THE INVENTION

It is therefore an object of the invention to further develop an apparatus of the type mentioned initially, in such a manner that venting after a container change is improved.

These and other objects are achieved, according to the invention, by an apparatus for conveying viscous material out of a barrel-like container having a container bottom and a container wall that extends upward from the container bottom. The apparatus has a follower plate for closing off the container, which plate is movable in the direction toward the container bottom, lying against the inner surface of the container wall, which surface faces the container interior, and which plate has a dome that extends upwards from an underside intended to lie on the viscous material, which dome opens, in the center, into a material exit opening. The apparatus has a pump for conveying the viscous material through the material exit opening and at least one displacement body that projects into the dome through the material exit opening and is connected with the pump for displacement of the material situated in the dome and/or air situated in the dome, as well as at least one closeable venting opening for venting the dome. Advantageous further developments of the invention are discussed below.

The invention is based on the idea of removing air and material mixed with air not by means of the pump, but rather by way of at least one closable venting opening. In order to force air or material mixed with air out of the venting opening, a displacement body connected with the pump is provided, which body is immersed in the dome and displaces volume. During this displacement, air and material mixed with air are predominantly conducted away by way of the venting opening(s), before they can get into the pump.

It is possible to configure the displacement body in one piece with the pump or its housing, and also to dispose the venting opening(s) in the pump housing. It is preferred, however, that an intermediate piece is disposed between the pump and the dome, which piece has the displacement body or bodies and the venting opening(s). The intermediate piece can particularly be coupled with usual pumps, which can be retrofitted in this manner.

The intermediate piece can have a valve for opening and closing each of the filling openings. Venting can then take place, for example, by means of manual opening of the valve, or also by means of automated control of the valve, which then remains open for a predetermined period of time, for example. According to a preferred embodiment, the intermediate piece is in two parts, with a lower part that has the at least one displacement body and the venting opening(s), and with a closure part that can be moved, relative to the lower part, between a closed position, in which it closes the venting opening(s), and an open position, in which it releases the venting opening(s). In this connection, it is preferred that the closure part has a closure section that is accommodated in the lower part and is guided in linearly displaceable manner there. Closing the venting opening(s) then takes place simply by means of displacing the closure part relative to the lower part. In this connection, it is practical if the closure part can be moved from the open position into the closed position counter to a reset force, so that application of force is required to displace the closure part.

The reset force is preferably applied by means of pressure springs that are disposed between a circumferential flange of the lower part and a circumferential flange of the closure part, at equal angular distances relative to one another. It is advantageous if the lower part and the closure part are connected with one another by means of connection bolts, which are firmly anchored in one of the two parts and passed through the other of the two parts, forming an end stop. In particular, it is possible to dispose the pressure springs around the connection bolts, which then connect the two flanges with one another. It is practical if the closure section lies on a step of the lower part in the closed position, so that its position is precisely defined.

The intermediate piece can be loosely set onto the dome and connected with the pump, wherein a releasable connection is preferred. It is also possible, however, that the intermediate piece is connected not only with the dome but also with the pump, wherein once again, releasable connections are preferred. It is advantageous if the intermediate piece has multiple venting openings that are disposed at the same angular distances from one another.

It is practical if the pump has a scoop piston movable between a lower and an upper end position. In the lower end position, the scoop piston is situated in the dome, while it is situated in an end region of the pump in the upper end position, above the intermediate part. The up and down movement of the scoop piston during the pumping process scoops material in the dome in the direction of the material exit opening. The scoop piston can further contribute to reducing the size of the air bubble when the barrel is changed, right from the start, in that it is brought into a position, before the pump and the intermediate piece and the follower plate are lifted up, in which position its greatest diameter is situated at the level of the lower edge of the closure section and/or at a level directly above the venting opening(s). As a result, a small tear-off surface of the material in the form of a circular ring around the scoop piston is achieved, so that the cohesion forces that occur there, which pull material downward from above the tear-off surface, are minimized.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figures 1A, 1B:
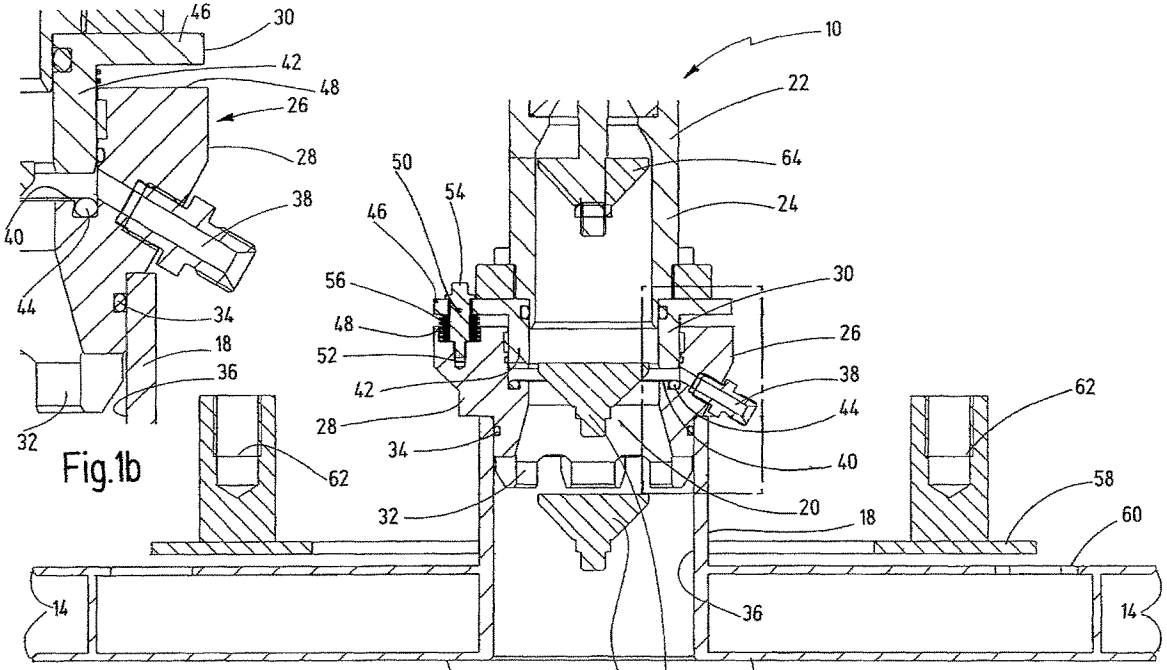
FIGS. 1*a*, 1*b* and 1*c* show an apparatus for conveying viscous material, in cross-section, according to a first exemplary embodiment, as well as a detail representation of the sectional representation and a perspective representation of the intermediate piece.
Figure 1C:
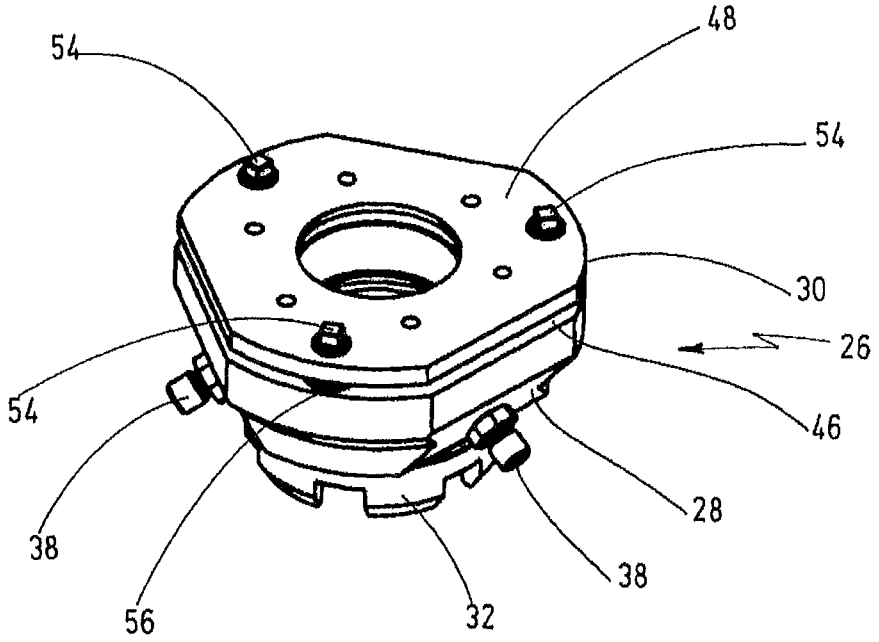

The apparatus 10 shown in FIGS. 1*a*, 1*b* and 1*c* serves for conveying viscous material, such as, for example, adhesive, sealant or insulation material, out of a barrel-like container, which is not shown here. It has a follower plate 12 that is introduced into the container and with its circumferential edge 14 lies against the inner surface, in the form of a cylindrical mantle, of the container, forming a seal, and lies on the surface of the material situated in the container with its underside 16. In the center, the follower plate 12 has a dome 18 that extends upward from the underside 16, which dome opens into a material exit opening 20. Furthermore, the apparatus 10 has a scoop piston pump 22, the end region 24 of which is shown in FIG. 1*a*. The pump 22 serves for conveying the viscous material out of the container, through the material exit opening 20, to a processing apparatus.

The pump 22 is not directly connected with the dome 18, but rather an intermediate piece 26 is disposed between the two, which piece is configured in two parts, with a lower part 28 and a closure part 30. The lower part 28 is loosely set onto the dome 18 and has a circumferential displacement body 32, which is immersed in the dome 18. A sealing ring 34 is circumferentially disposed on the displacement body 32, which ring lies against an inner surface 36 of the dome 18, forming a seal. In the lower part 28, there are furthermore three venting openings 38, disposed at the same angular distance from one another, by way of which openings air situated in the dome 18, in each instance, can be conducted away through the lower part 28. The venting openings 38 each open directly above a step that projects radially inward, into the interior of the lower part 28.

The closure part 30, which is firmly and releasably connected with the pump 22, has a closure section 42 in the form of a cylindrical mantle, which section is accommodated in the lower part 28 and guided there so as to be linearly displaceable in the axial direction.

In FIG. 1*a*, an open position is shown, in which the closure part 30 is raised farthest from the step 40 and completely releases the venting openings 38. In a closure position, the closure section 42 lies on the step 40, in which a circumferential sealing ring 44 is disposed for sealing.

In the closed position, a circumferential flange 46 of the closure part 30, which flange projects radially away from the closure section 42, furthermore lies on a circumferential flange 48 of the lower part 28, which flange also projects radially away.

The connection between the lower part 28 and the closure part 30 is produced by means of three screw bolts 50, which are disposed at equal angular distances from one another, the threads 52 of which bolts are each screwed into a threaded bore in the flange 48 of the lower part 28, and which are passed through bores in the flange 46 of the closure part 30, wherein a head 54 situated above the flange 46 of the closure part 30 forms an end stop, which establishes the open position.

Pressure springs 56 are disposed around the screw bolts 50, which springs are supported on the lower part 28 and on the closure part 30, so that the movement of the closure part 30 from the open position into the closed position takes place counter to the reset force of the pressure springs 56.

Furthermore, a pressure plate 58 is provided, which is intended to lie against a top side 60 of the follower plate 12. The pressure plate 58 is configured in the shape of a circular ring and disposed around the dome 18. It is firmly connected with an upper region of the pump 22 by way of threaded rods, not shown in any detail in the drawing, that are screwed into threaded bores 62. Pressure is applied to the follower plate 12 by way of the pressure plate 58, so that it can follow the decreasing material level in the container downward, sliding along the inner surface of the container.

The pump 22 has a scoop piston 64, which can be moved up and down in the axial direction, in which the closure part 30 is also displaceable relative to the lower part 28, and in which the follower plate 12 is also moved in the container to follow the material level. In FIG. 1*a*, the scoop piston 64 is shown in a lower end position in the dome 18, in an upper end position in the end region 24 of the pump 22, and in an intermediate position. In the intermediate position, the largest diameter of the pump piston 62 is at the level of the lower edge of the closure section 42.

When a container change takes place, the pump 22 together with intermediate piece 26 and pressure plate 58 is lifted off the follower plate 12, which remains in the container, and the container with the follower plate 12 is transported to refilling.

Before lifting off takes place, the scoop piston 64 is brought into the intermediate position, so that only a small tear-off surface of the viscous material, in the form of a thin circular ring, remains in the interior of the closure section 42. In this manner, only little material is pulled downward out of the end region 24 of the pump 22 as the result of cohesion forces, so that only a small cavity is formed there.

After delivery of a filled container, the pump 22 together with intermediate piece 26 and pressure plate 58 is set onto the follower plate 12 of this container, wherein the displacement body 32 is immersed in the dome 18 and displaces material, so that air contained in the dome 18 at first can escape through the venting openings 38.

When the displacement body 32 has been completely introduced into the dome 18, force is applied to the closure part 30 from above, by way of the pump 22, until its closure section 42 lies on the step 40, closing off the venting openings 38.

Figures 2A, 2B:
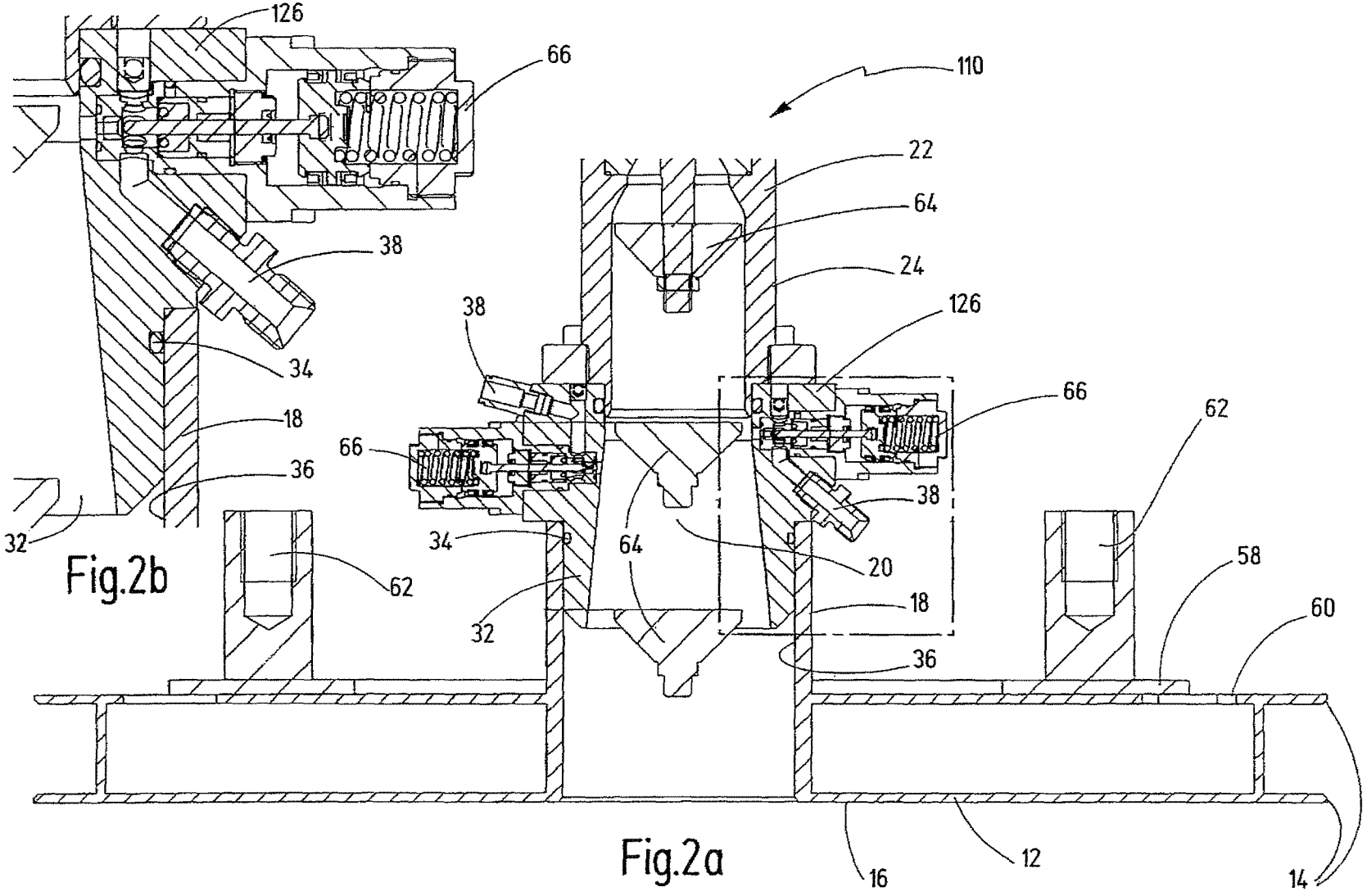
FIGS. 2*a*, 2*b* and 2*c* show an apparatus for conveying viscous material, in cross-section, according to a second exemplary embodiment, as well as a detail representation of the sectional representation and a perspective representation of the intermediate piece.
Figure 2C:
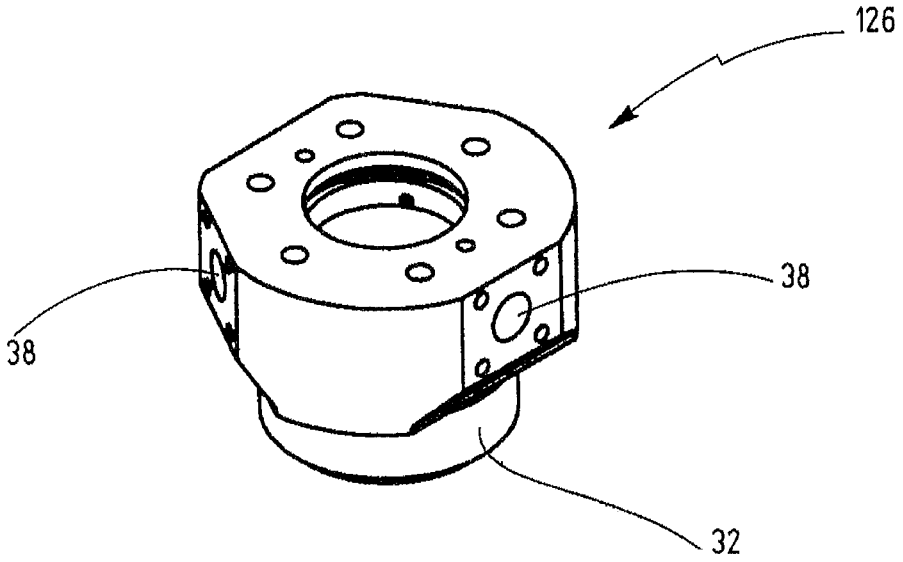

The apparatus 110 according to the second exemplary embodiment (FIGS. 2*a*, 2*b* and 2*c*) differs only in details from the apparatus 10 according to the first exemplary embodiment. The same parts are therefore provided with the same reference symbols.

The main difference consists in that the apparatus 110 according to the second exemplary embodiment has a one-part intermediate piece 126. Its venting openings 38 can be closed off by means of valves 66, which can be activated manually or automatically. When a container is emptied, then just like in the case of the first exemplary embodiment, the pump 22 together with intermediate piece 126 and pressure plate 58 are lifted off the follower plate 12 and set onto the follower plate 12 of a filled container, wherein the displacement body 32 is immersed in the dome. In this connection, the valves 66 are in the open position, in which the venting openings 38 are released. They are closed as soon as the intermediate piece sits on the dome, wherein then, the pressure plate 58 also lies on the follower plate 12. For the remainder, reference is made to the figure description of the first exemplary embodiment, with the difference that the intermediate position of the scoop piston 64 is defined in that its largest diameter is disposed in the region of the venting openings 38 or directly above it.

In summary, the following should be stated: The invention relates to an apparatus 10, 110 for conveying viscous material out of a barrel-like container having a container bottom and a container wall that extends upward from the container bottom, the apparatus having a follower plate 12 for closing off the container, which plate is movable in the direction toward the container bottom, lying against the inner surface of the container wall, which surface faces the container interior, and which plate has a dome 18 that extends upward from an underside 16 intended to lie on the viscous material, which dome opens, in the center, into a material exit opening 20, and having a pump 22 for conveying the viscous material through the material exit opening 20. According to the invention, at least one displacement body 32 that projects into the dome 18 through the material exit opening 20 and is connected with the pump 22 for displacement of the material situated in the dome 18 and/or air situated in the dome 18 is provided, as well as at least one closeable venting opening 38 for venting the dome 18.

Although only at least two embodiments of the present invention have been shown and described, it is to be understood that many changes and modifications may be made thereunto without departing from the spirit and scope of the invention.

What is claimed is:

1. An apparatus for conveying viscous material out of a barrel-shaped container having a container interior, a container bottom and a container wall extending upward from the container bottom and having an inner surface facing the container interior, the apparatus comprising:

(a) a follower plate lying against the inner surface of the container wall for closing off the container and movable in a direction toward the container bottom, said plate having an underside intended to lie on the viscous material, a middle portion, a material exit opening, and a dome positioned in the middle portion, extending upward from the underside, and opening into the material exit opening;

(b) a pump for conveying the viscous material through the material exit opening;

(c) at least one displacement body projecting into the dome through the material exit opening and connected with the pump for displacement of at least one of the material situated in the dome and air situated in the dome;

(d) at least one closeable venting opening for venting the dome; and (e) an intermediate piece disposed between the pump and the dome, wherein the intermediate piece has the at least one displacement body and the at least one venting opening;

wherein the intermediate piece comprises a lower part that has the at least one displacement body and the at least one venting opening, and a closure part that is moveable, relative to the lower part, between a closed position, in which the closure part closes the at least one venting opening, and an open position, in which the closure part releases the at least one venting opening; and wherein the closure part is movable from the open position into the closed position counter to a reset force.

2. The apparatus according to claim 1, wherein the closure part has a closure section that is accommodated in the lower part and guided in the lower part in a linearly displaceable manner.

3. The apparatus according to claim 2, wherein the closure section lies on a step of the lower part.

4. The apparatus according to claim 1, wherein the lower part has a first circumferential flange and the closure part has a second circumferential flange, and wherein pressure springs that apply the reset force are disposed between the first and second circumferential flanges, at equal angular distances.

5. The apparatus according to claim 4, wherein the lower part and the closure part are connected with one another by connection bolts, wherein the connection bolts are anchored in one of the lower part and the closure part and are passed through another of the lower part and the closure part, forming an end stop.

6. The apparatus according to claim 1, wherein the intermediate piece is set loosely onto the dome and is connected with the pump.

7. The apparatus according to claim 6, wherein the intermediate piece is releasably connected with the pump.

8. The apparatus according to claim 1, wherein the intermediate piece is connected with the dome and with the pump.

9. The apparatus according to claim 8, wherein the intermediate piece is releasably connected with the dome and with the pump.

10. The apparatus according to claim 1, wherein the intermediate piece has a plurality of venting openings disposed at equal angular distances from one another.

11. The apparatus according to claim 1, wherein the pump has a scoop piston that is movable, in linearly displaceable manner, between a lower end position, in which the scoop piston is disposed in the dome, and an upper end position, in which the scoop piston is disposed in an end region of the pump, above the intermediate piece.

12. A method for changing a barrel-shaped container using an apparatus for conveying viscous material out of the barrel-shaped container, wherein the barrel-shaped container has a container interior, a container bottom and a container wall extending upward from the container bottom and having an inner surface facing the container interior, the method comprising:

(a) providing the apparatus, wherein the apparatus comprises a first follower plate lying against the inner surface of the container wall for closing off the container and movable in a direction toward the container bottom, said plate having an underside intended to lie on the viscous material, a middle portion, a material exit opening, and a dome positioned in the middle portion, extending upward from the underside, and opening into the material exit opening;

a pump for conveying the viscous material through the material exit opening, the pump having a scoop piston that is moveable, in linearly displaceable manner, between a lower end position and an upper end position; and an intermediate piece disposed between the pump and the dome, wherein the intermediate piece comprises (i) a lower part that has at least one displacement body and at least one closable venting opening, the at least one displacement body projecting into the dome through the material exit opening and connected with the pump for displacement of at least one of the material situated in the dome and air situated in the dome, the at least one closeable venting opening being for venting the dome, and (ii) a closure part that is moveable, relative to the lower part, between a closed position, in which the closure Part closes the at least one venting opening, and an open position, in which the closure part releases the at least one venting opening, the closure part having a closure section that is accommodated in the lower part and guided in the lower part in a linearly displaceable manner, wherein in the lower end position the scoop piston is disposed in the dome, and in the upper end position the scoop piston is disposed in an end region of the pump, above the intermediate piece;

(b) bringing the scoop piston into a scoop piston position, in the scoop piston position a largest diameter of the scoop piston being situated at a level of a lower edge of the closure section or at a level directly above the at least one venting opening;

(c) after bringing the scoop piston into the scoop piston position, lifting the pump and the intermediate piece off the first follower plate situated in an emptied container and with the at least one closable venting opening open placing the pump and the intermediate piece onto a second follower plate situated in a filled container;

(d) introducing the at least one displacement body into the dome to displace at least one of the air and the material; and (e) closing the at least one venting opening after complete introduction of the at least one displacement body into the dome.

13. An apparatus for conveying viscous material out of a barrel-shaped container having a container interior, a container bottom and a container wall extending upward from the container bottom and having an inner surface facing the container interior, the apparatus comprising:

(a) a follower plate lying against the inner surface of the container wall for closing off the container and movable in a direction toward the container bottom, said plate having an underside intended to lie on the viscous material, a middle portion, a material exit opening, and a dome positioned in the middle portion, extending upward from the underside, and opening into the material exit opening;

(b) a pump for conveying the viscous material through the material exit opening;

(c) at least one displacement body projecting into the dome through the material exit opening and connected with the pump for displacement of at least one of the material situated in the dome and air situated in the dome;

(d) at least one closeable venting opening for venting the dome; and (e) an intermediate piece disposed between the pump and the dome, wherein the intermediate piece has the at least one displacement body and the at least one venting opening;

wherein the intermediate piece comprises a lower part that has the at least one displacement body and the at least one venting opening, and a closure part that is moveable, relative to the lower part, between a closed position, in which the closure part closes the at least one venting opening, and an open position, in which the closure part releases the at least one venting opening;

wherein the closure part has a closure section that is accommodated in the lower part and guided in the lower part in a linearly displaceable manner; and wherein the closure section lies on a step of the lower part.

* * * * *